US011570558B2

(12) United States Patent
Gigandet

(10) Patent No.: US 11,570,558 B2
(45) Date of Patent: Jan. 31, 2023

(54) STEREO RENDERING SYSTEMS AND METHODS FOR A MICROPHONE ASSEMBLY WITH DYNAMIC TRACKING

(71) Applicant: SONOVA AG, Staefa (CH)

(72) Inventor: Xavier Gigandet, Cousset (CH)

(73) Assignee: Sonova AG, Staefa (CH)

( * ) Notice: Subject to any disclaimer, the term of this patent is extended or adjusted under 35 U.S.C. 154(b) by 86 days.

(21) Appl. No.: 17/161,517

(22) Filed: Jan. 28, 2021

(65) Prior Publication Data

US 2022/0240027 A1 Jul. 28, 2022

(51) Int. Cl.

| | |
|---|---|
| ***H04R 25/00*** | (2006.01) |
| ***H04R 1/40*** | (2006.01) |
| ***H04R 3/00*** | (2006.01) |
| ***G10L 25/78*** | (2013.01) |
| ***H04R 1/04*** | (2006.01) |

(52) U.S. Cl.

CPC ..... *H04R 25/552* (2013.01); *G10L 25/78* (2013.01); *H04R 1/04* (2013.01); *H04R 1/406* (2013.01); *H04R 3/005* (2013.01); *H04R 25/405* (2013.01); *H04R 25/407* (2013.01); *H04R 25/554* (2013.01); *H04R 2201/401* (2013.01)

(58) Field of Classification Search

CPC . H04R 2205/041; H04R 25/00; H04R 25/405

USPC ..... 381/23.1

See application file for complete search history.

(56) References Cited

U.S. PATENT DOCUMENTS

| | | | | |
|---|---|---|---|---|
| 9,706,292 | B2 | 7/2017 | Duraiswami et al. | |
| 2008/0262849 | A1 | 10/2008 | Buck et al. | |
| 2010/0324890 | A1 | 12/2010 | Adeney | |
| 2014/0161304 | A1* | 6/2014 | Diggins | G06T 1/0028 382/100 |
| 2016/0210872 | A1* | 7/2016 | Roberts | G09B 19/04 |

(Continued)

FOREIGN PATENT DOCUMENTS

| | | |
|---|---|---|
| EP | 1879426 | 1/2008 |
| EP | 2840807 | 2/2015 |
| EP | 1423988 | 3/2015 |

(Continued)

*Primary Examiner* — Katherine A Faley

(74) *Attorney, Agent, or Firm* — ALG Intellectual Property, LLC

(57) ABSTRACT

An illustrative stereo rendering system obtains a contradirectional audio input signal generated by a microphone assembly having a plurality of microphone elements. The contradirectional audio input signal implements a contradirectional polar pattern oriented with respect to a listener. The system also obtains an array of multidirectional audio input signals generated by the microphone assembly. The array of multidirectional audio input signals implements different unidirectional polar patterns that are collectively omnidirectional in a horizontal plane. The system generates a weighted audio input signal by mixing the array of multidirectional audio input signals in accordance with respective weight values assigned to each multidirectional audio input signal. The system then generates, based on the contradirectional audio input signal and the weighted audio input signal, a stereo audio output signal for presentation to the listener. Corresponding systems and methods are also disclosed.

20 Claims, 9 Drawing Sheets

(56) References Cited

U.S. PATENT DOCUMENTS

2021/0134314 A1* 5/2021 Bharitkar ..... G10L 21/034

FOREIGN PATENT DOCUMENTS

| | | |
|---|---|---|
| WO | 1997048252 | 12/1997 |
| WO | 2005048648 | 5/2005 |
| WO | 2008098590 | 8/2008 |
| WO | 2017174136 | 10/2017 |
| WO | 2019233588 | 12/2019 |

* cited by examiner

STEREO RENDERING SYSTEMS AND METHODS FOR A MICROPHONE ASSEMBLY WITH DYNAMIC TRACKING

BACKGROUND INFORMATION

Hearing devices (e.g., hearing aids, cochlear implants, etc.) are used to improve the hearing and/or communication capabilities of hearing device users (also referred to herein as "listeners"). To this end, hearing devices may be configured to receive and process an audio input signal (e.g., ambient sound picked up by a microphone, prerecorded sound such as music provided over a line input, etc.), and to present the processed audio input signal to the user (e.g., by way of acoustic stimulation from a speaker in the case of a hearing aid, by way of electrical stimulation from an implanted electrode lead in the case of a cochlear implant, etc.).

While many hearing devices include one or more built-in microphones housed in the hearing device (e.g., so as to be positioned near the ear canal as the hearing device is worn at the user's ear), it may be advantageous, in certain circumstances, for external microphone assemblies to capture and provide an audio input signal. For example, a hearing device user may place an external microphone assembly (e.g., a "table microphone," etc.) on a conference room table during a meeting, on a dinner table during a meal, or the like. Such microphones assemblies may be configured to clearly capture voices and ambient sounds in the room that may be captured suboptimally by built-in hearing device microphones alone. Accordingly, in certain situations, the user may be presented with improved sound quality when an audio input signal is received from an external microphone assembly instead of or in addition to audio input signals captured by one or more built-in microphones of the hearing device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
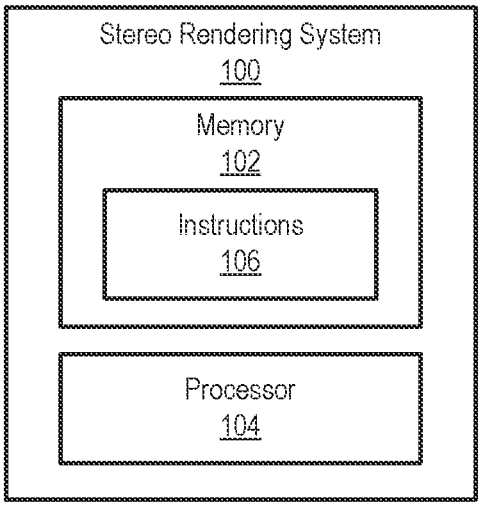
FIG. 1 shows an illustrative stereo rendering system configured to perform stereo rendering for a microphone assembly with dynamic tracking according to principles described herein.

Stereo rendering systems and methods for a microphone assembly with dynamic tracking are described herein. Stereo rendering, as used herein, refers to presentations of sound that differentiate signals presented to each ear of a user (as opposed to monaural rendering, where both ears would be presented with identical signals). Stereo rendering of an audio input signal may be desirable for many reasons. For instance, stereo rendering may allow a listener to identify interaural cues (e.g., interaural level differences ("ILDs"), interaural time differences ("ITDs"), etc.) that facilitate the listener in localizing the source of a sound in the room (e.g., which direction the sound is coming from, etc.). As another example, stereo rendering may help a listener focus in on one sound over another (e.g., a sound coming from straight ahead instead of a sound coming from one side or noise coming from multiple directions) to thereby improve how well the listener can understand speech when multiple people are talking at once or there is a lot of ambient noise, as well as improve how well the listener can identify who is speaking and/or distinguish between different speakers.

Microphone assemblies with dynamic tracking, as used herein, refer to systems or devices that include one or more microphone elements and that are configured to detect and continuously track where a primary sound within a particular environment (e.g., a main presenter speaking in a conference room, etc.) originates from, even when other secondary sounds or noise (e.g., people speaking in low voices during the conference room presentation, a fan in the corner of the conference room, etc.) are also present. Based on the direction of the primary sound, microphone assemblies with a dynamic tracking feature may dynamically perform beamforming operations to attempt to automatically focus in on primary sounds while at least somewhat filtering out undesirable secondary sounds. Accordingly, an audio signal provided by a microphone assembly with a dynamic tracking feature may tend to emphasize (e.g., amplify) speech spoken by a primary presenter in a conference room scenario while deemphasizing (e.g., attenuating) noise in the room. Additionally, as different people may speak up (e.g., asking questions to a presenter, discussing a topic in a back and forth manner, etc.), such microphone assemblies may capture the discussion and continuously attempt to focus in on whatever sound is the primary sound from moment to moment.

Systems and methods described herein include both stereo rendering and dynamic tracking features to allow listeners to enjoy a stereo rendering of ambient sound in which primary sounds are emphasized while noise is deemphasized. While stereo rendering and dynamic tracking features both clearly provide advantages on their own, stereo rendering systems and methods described herein for use with microphone assemblies having dynamic tracking features provide significant benefits and advantages that conventional systems fail to provide. For example, rather than merely attempting to reproduce an acoustic scene with perfect stereo fidelity, as a conventional stereo sound pick-up technique might do, stereo rendering systems described herein are configured to isolate primary sounds by adaptive beamforming, and then enhance those sounds (e.g., by processing the sounds to improve a signal-to-noise ratio, applying advanced noise cancellation, etc.) before they are presented to the listener within a configurable stereo rendering. These benefits and various others made apparent herein may allow hearing device users to confidently engage in various challenging hearing scenarios and localize, distinguish, and understand speech in these scenarios in a comfortable and accurate manner.

Various specific implementations will now be described in detail with reference to the figures. It will be understood that the specific implementations described below are provided as non-limiting examples of how various novel and inventive principles may be applied in various situations. Additionally, it will be understood that other examples not explicitly described herein may also be captured by the scope of the claims set forth below. Stereo rendering systems and methods described herein for microphone assemblies with dynamic tracking may provide any of the benefits mentioned above, as well as various additional and/or alternative benefits that will be described and/or made apparent below.

FIG. 1 shows an illustrative stereo rendering system 100 ("system 100") configured to perform stereo rendering for a microphone assembly with dynamic tracking in accordance with principles described herein. System 100 may be implemented in various different ways by different types of systems. For instance, as will be illustrated and described in more detail below, an external microphone assembly system such as various table microphone devices described herein may include processors, memory, and/or other circuitry that collectively implement system 100.

As illustrated in FIG. 1, system 100 may include, without limitation, a memory 102 and a processor 104 selectively and communicatively coupled to one another. Memory 102 and processor 104 may each include or be implemented by computer hardware that is configured to store and/or execute computer instructions (e.g., software, firmware, etc.). Various other components of computer hardware and/or software not explicitly shown in FIG. 1 may also be included within an implementation of system 100. In some examples, memory 102 and processor 104 may be distributed between multiple interconnected devices as may serve a particular implementation.

Memory 102 may store and/or otherwise maintain executable data used by processor 104 to perform any of the functionality described herein. For example, memory 102 may store instructions 106 that may be executed by processor 104. Memory 102 may be implemented by one or more memory or storage devices, including any memory or storage devices described herein, that are configured to store data in a transitory or non-transitory manner. Instructions 106 may be executed by processor 104 to cause system 100 to perform any of the functionality described herein. Instructions 106 may be implemented by any suitable application, software, firmware, script, code, and/or other executable data instance. Additionally, memory 102 may also maintain any other data accessed, managed, used, and/or transmitted by processor 104 in a particular implementation.

Processor 104 may be implemented by one or more computer processing devices, including general purpose processors (e.g., central processing units ("CPUs"), microprocessors, etc.), special purpose processors (e.g., application-specific integrated circuits ("ASICs"), field-programmable gate arrays ("FPGAs"), etc.), or the like. Using processor 104 (e.g., when processor 104 is directed to perform operations represented by instructions 106 stored in memory 102), system 100 may perform functions associated with stereo rendering for a microphone assembly with dynamic tracking as described herein and/or as may serve a particular implementation.

Figure 2:
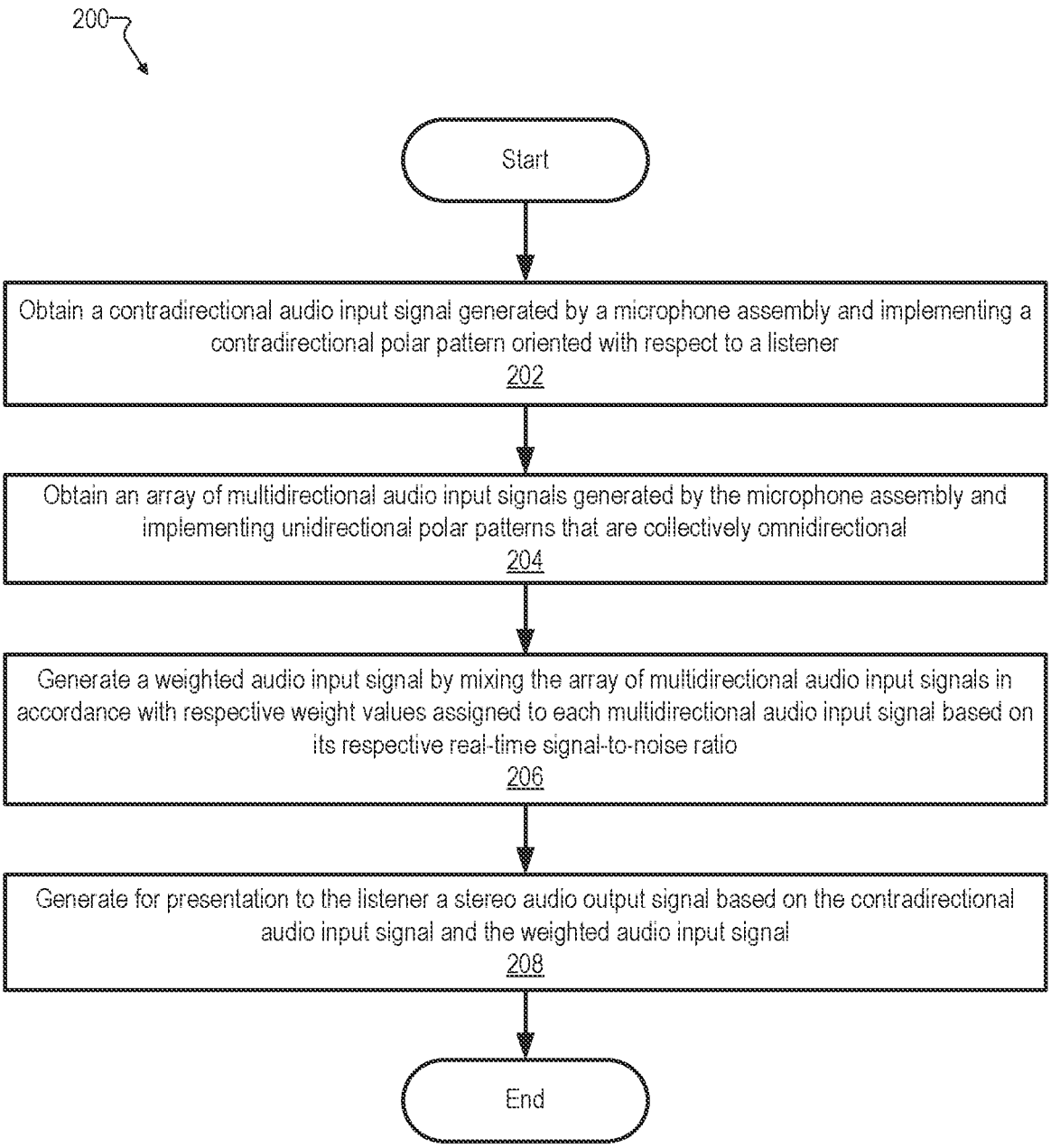
FIG. 2 shows an illustrative method of stereo rendering for a microphone assembly with dynamic tracking according to principles described herein.

As one example of functionality that processor 104 may perform, FIG. 2 shows an illustrative method 200 of stereo rendering for a microphone assembly with dynamic tracking according to principles described herein. While FIG. 2 shows illustrative operations according to one implementation, other implementations may omit, add to, reorder, and/or modify any of the operations shown in FIG. 2. In some examples, multiple operations shown in FIG. 2 or described in relation to FIG. 2 may be performed concurrently (e.g., in parallel) with one another, rather than being performed sequentially as illustrated and/or described. One or more of the operations shown in FIG. 2 may be performed by a stereo rendering system such as system 100, an implementation thereof, or by other suitable systems or devices as may serve a particular implementation.

In some examples, the operations of FIG. 2 may be performed in real time so as to provide, receive, process, and/or use data and signals described herein immediately as the data and signals are generated, updated, changed, exchanged, or otherwise become available. Moreover, certain operations described herein may involve real-time data, real-time representations, real-time conditions, and/or other real-time circumstances. As used herein, "real time" will be understood to relate to data processing and/or other actions that are performed immediately, as well as conditions and/or circumstances that are accounted for as they exist in the moment when the processing or other actions are performed. For example, a real-time operation may refer to an operation that is performed immediately and without undue delay, even if it is not possible for there to be absolutely zero delay. Similarly, real-time data, real-time representations, real-time conditions, and so forth, will be understood to refer to data, representations, and conditions that relate to a present moment in time or a moment in time when decisions are being made and operations are being performed (e.g., even if after a short delay), such that the data, representations, conditions, and so forth are temporally relevant to the decisions being made and/or the operations being performed.

Each of operations 202-208 of method 200 will now be described in more detail as the operations may be performed by system 100, an implementation thereof, or another suitable stereo rendering system.

At operation 202, system 100 may obtain a contradirectional audio input signal generated by a microphone assembly having a plurality of microphone elements. The contradirectional audio input signal may implement a contradirectional polar pattern oriented with respect to a listener.

As used herein, a "contradirectional" signal or polar pattern refers to a directional signal or polar pattern that has two lobes facing in substantially opposite directions. For example, a figure-of-eight (also known as a figure-eight) signal or polar pattern may serve as one example of a contradirectional signal or polar pattern. Other examples may be similar to a figure-of-eight signal or polar pattern but may have lobes that are turned at least somewhat inward so as not to be completely opposite of one another. In these examples, as long as the lobes are directed in substantially opposite directions (e.g., making an angle near 180°, an angle between 90° and 270°, etc.) the signal or polar pattern will be considered to be contradirectional as that term is used herein. Accordingly, in certain examples, the contradirectional audio input signal obtained at operation 202 may be a figure-of-eight audio input signal captured by microphone elements that have a figure-of-eight polar pattern or generated by a beamforming operation to create a figure-of-eight polar pattern.

As used herein, a contradirectional audio input signal is "oriented with respect to a listener" when the polar pattern of the signal is aligned such that the contradirectional lobes are substantially oriented in the same way as the ears of the listener. For example, if a listener is facing forward (at an angle of 0°), a contradirectional audio input signal oriented with respect to the listener would have two lobes that are directed substantially to the left (e.g., at an angle of approximately 90°) and to the right (e.g., at an angle of approximately −90° or 270°). It will be understood that a contradirectional audio input signal may be considered to be oriented with respect to a listener based on how a hardware device is oriented with respect to the listener's position (e.g., how a contradirectional microphone is situated based on a seat of the listener at the table), and not necessarily on how the listener turns his or her head (i.e., such that a static orientation of a contradirectional polar pattern remains oriented with respect to the listener when the listener turns his or her head but stays seated in the same seat).

At operation 204, system 100 may obtain an array of multidirectional audio input signals generated by the microphone assembly (e.g., using the same or different microphone elements as those that captured the sound used to generate the contradirectional audio input signal of operation 202). The array of multidirectional audio input signals may implement different unidirectional polar patterns that are collectively omnidirectional in a horizontal plane (e.g., a plane of a table on which a table microphone system is placed). For instance, in one example, the array may include six multidirectional audio input signals that each have a cardioid polar pattern that is directed in a way that uniformly covers a full 360° angle (e.g., a first signal directed at 0°, a second signal directed at 60°, a third signal directed at 120°, a fourth signal directed at 180°, a fifth signal directed at 240°, and a sixth signal directed at 300°). Along with covering the full 360° of the horizontal plane (e.g., a plane of a tabletop), the array of multidirectional audio input signals may also include input signals configured to cover angles outside of the horizontal plane (e.g., three-dimensional signals pointing up or down out of the table, etc.).

As used herein, a collection of signals or polar patterns that collectively cover (e.g., capture sound from) various angles around a 360° angle will be referred to as being "collectively omnidirectional" with regard to that angle (e.g., with regard to the plane along which the angle is set), even though each signal or polar pattern by itself may be a unidirectional or contradirectional signal or polar pattern that would not properly be referred to as omnidirectional. Examples of unidirectional signals that are collectively omnidirectional will be described and illustrated in more detail below.

At operation 206, system 100 may generate a weighted audio input signal by mixing the array of multidirectional audio input signals. For example, the mixing of the multidirectional audio input signals may be performed in accordance with respective weight values assigned to each multidirectional audio input signal in the array based on a respective real-time signal-to-noise ratio of each multidirectional audio input signal in the array. In this way, the weighted audio input signal may emphasize signals that are oriented in the direction of primary sounds in the environment (e.g., a main presenter in a conference room, a person telling a story to everyone at the table during a meal, etc.) while deemphasizing signals that are oriented in the direction of noise or secondary sounds in the environment (e.g., quiet side conversation around the conference room, people at other tables in a crowded restaurant during the meal, etc.). The weighting of each signal based on the respective real-time signal-to-noise ratios may be performed continuously and dynamically as the source of the primary sound changes (e.g., as different people take turns speaking in a dialogue or group discussion). The assigning of weight values will be described and illustrated in more detail below.

At operation 208, system 100 may generate a stereo audio output signal for presentation to the listener. Specifically, system 100 may generate the stereo audio output signal based on the contradirectional audio input signal obtained at operation 202 and the weighted audio input signal generated at operation 206. In this way, the stereo audio output signal may have the tracking and emphasizing benefits of the weighted audio input signal together with the stereo benefits of the contradirectional audio input signal. System 100 may provide this stereo audio output signal to a hearing device used by the listener (e.g., by way of wireless transmission, etc.) such that the stereo audio output signal can be presented to the listener and the listener can easily understand the primary sounds without being distracted by secondary noise (e.g., due to the tracking benefits of the weighted audio input signal) and can also easily localize and differentiate sound sources (e.g., due to the stereo benefits of the contradirectional audio input signal that is oriented to the listener).

Figure 3:
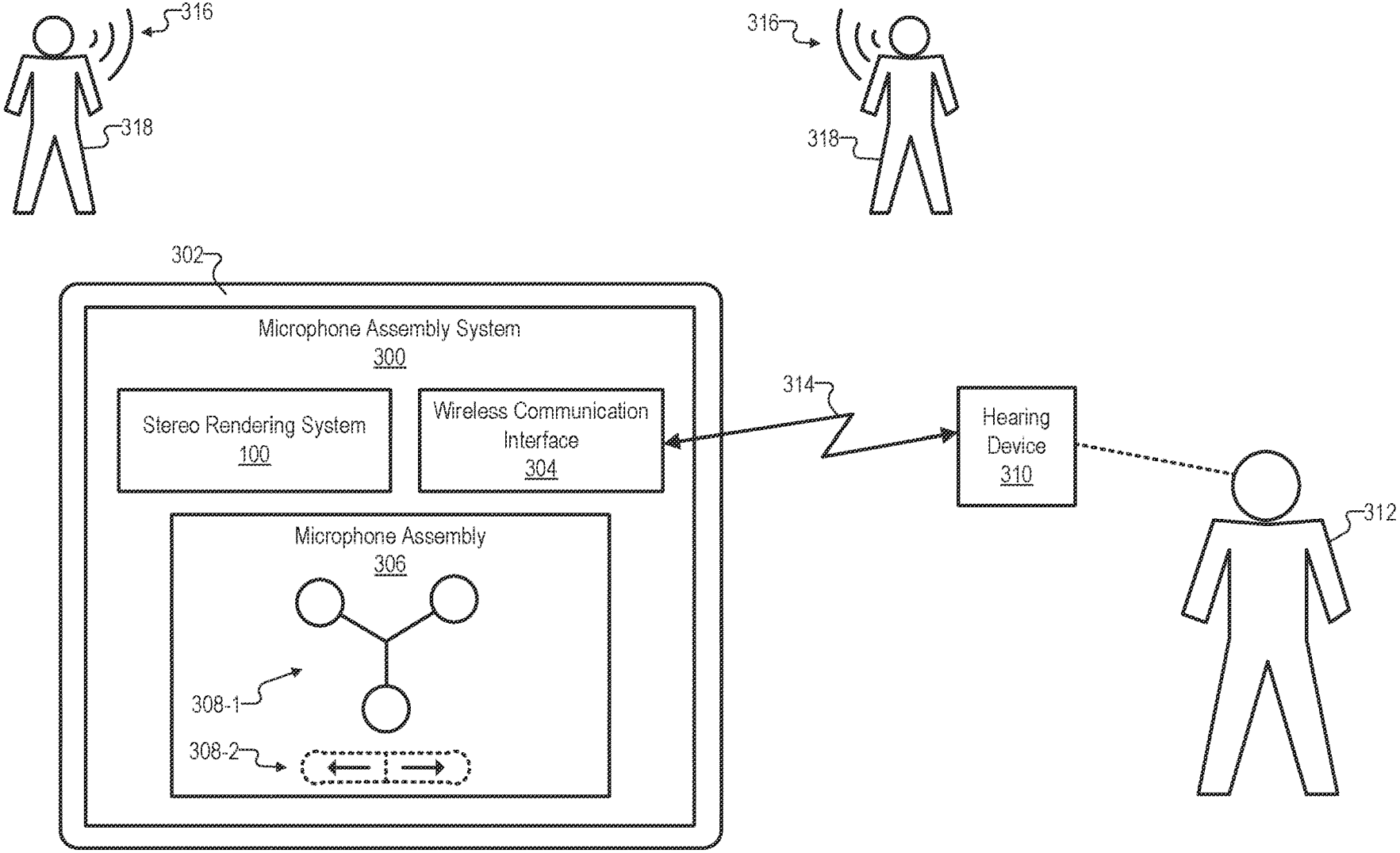
FIG. 3 shows an illustrative microphone assembly system implementing the stereo rendering system of FIG. 1 according to principles described herein.

To illustrate how system 100 and method 200 may function in operation, FIG. 3 shows an illustrative microphone assembly system 300 that implements system 100 in accordance with principles described herein. As shown, the components of microphone assembly system 300 may be fully or partially enclosed within a housing 302, and these components may include, without limitation, an implementation of system 100, a wireless communication interface 304, and a microphone assembly 306. Microphone assembly 306 may include a plurality of microphone elements 308 including microphone elements 308-1 configured to capture signals from which an array of multidirectional audio input signals is to be derived, as well as, in certain examples, a contradirectional microphone element 308-2 configured to capture a signal from which a contradirectional audio input signal is to be derived.

As further shown in FIG. 3, microphone assembly system 300 may be communicatively coupled to a hearing device 310 used by a listener 312. For example, the microphone assembly system and hearing device may be communicative coupled by way of a wireless link 314 (e.g., a Bluetooth link, a WiFi link, a wireless link based on a proprietary or custom protocol, etc.). In this way, a stereo audio output signal generated by system 100 may be provided to hearing device 310 for presentation to listener 312 by way of wireless communication interface 304 and wireless link 314. For instance, the stereo audio output signal may be generated in accordance with method 200 described above based on sounds 316 (e.g., speech sounds, etc.) that originate from one or more speakers 318 in the environment around listener 312. Microphone assembly system 300 and its components, as well as hearing device 310 will now be described in more detail.

Microphone assembly system 300 may be implemented as any suitable type of external microphone assembly system (e.g., a system that is separate from a hearing device worn by a listener). For example, in certain implementations, microphone assembly system 300 may be a portable, battery-powered table microphone device that listener 312 carries with him or her (e.g., in a pocket, purse, or briefcase) and that is configured to be powered on and situated in front of listener 312 when seated at a table with others (e.g., during a meeting, meal, conversation, or the like). In other implementations, microphone assembly system 300 may be permanently or semi-permanently built into a table such as a conference room table and may receive power from an outlet. In this example, listener 312 may not need to bother with carrying and setting up the microphone assembly system, since it would already be set up on the table. In still other implementations, microphone assembly system 300 may be integrated (e.g., built into) other devices and/or systems so as to share a common housing, processing circuitry, and/or microphone elements with the other devices or systems. For instance, an implementation of microphone assembly system 300 may be integrated with a conference phone that resides semi-permanently on a conference table in a conference room.

Housing 302 may take any form factor (e.g., size, shape, etc.) as may serve any of the various types of implementations described herein. For example, housing 302 may have a small, portable form (e.g., of a pocket-sized device); a larger, less portable form (e.g., of a conference phone); a form that is permanently integrated into a conference table; or the like. In any of these implementations, housing 302 may be configured to enclose processor and memory resources implementing system 100, circuitry implementing wireless communication interface 304, and various microphone elements of microphone assembly 306 in a manner that serves the particular implementation.

Wireless communication interface 304 may be any suitable type of communication interface configured to wirelessly transmit data (e.g., a stereo audio output signal) from housing 302 of microphone assembly system 300 to hearing device 310 (which, as mentioned above, may be separate from microphone assembly system 300 and worn by listener 312). Various types of wireless and/or networking technologies may be employed or implemented by wireless communication interface 304 to this end. For instance, Bluetooth and WiFi are common wireless protocols that may be used for these purposes. In other examples, other similar protocols, including proprietary and/or customized protocols, may be employed.

Microphone assembly 306 may include any suitable microphone elements 308 as may serve a particular implementation. For example, as shown in FIG. 3, microphone assembly 306 may include a plurality of (e.g., at least three) omnidirectional microphone elements 308-1 that each are configured to capture sound from all directions. Beamforming operations may be performed on such signals to generate multidirectional audio input signals that are collectively omnidirectional in the horizontal plane, as will be described in more detail below. In other examples, microphone elements included within microphone assembly 306 could employ directional polar patterns (e.g., cardioid polar patterns, etc.), rather than the omnidirectional polar patterns illustrated in FIG. 3 for microphone elements 308-1. For instance, six cardioid microphones could be arranged within housing 302 to point outward from the housing (e.g., so as to capture sound from outside housing 302 rather than sound from inside housing 302) such that multidirectional audio input signals would be generated by the microphone elements without beamforming being performed.

As further shown within microphone assembly 306, one or more microphone elements 308-2 may also be included within the plurality of microphone elements 308. Microphone elements 308-2 may be distinct and separate from the plurality of microphone elements 308-1, and may be configured to capture one or more audio signals from which the contradirectional audio input signal is derived. For example, a single microphone element having a contradirectional polar pattern may implement microphone element 308-2 in certain examples, while back-to-back unidirectional microphone elements or other such configurations may be used in other implementations.

The configuration illustrated in FIG. 3 shows separate microphone elements 308 used to capture signals for the multidirectional audio input signals (microphone elements 308-1) and used to capture signals for the contradirectional audio input signal (microphone element 308-2). However, as illustrated by the dotted line with which microphone element 308-2 is drawn, it will be understood that this distinct and separate implementation of microphone element 308-2 is optional. Rather than implementing this microphone element separately, for example, certain implementations of microphone assembly 306 may use the plurality of microphone elements 308-1 to capture audio signals from which both 1) the array of multidirectional audio input signals and 2) the contradirectional audio input signal are derived. Such implementations may allow for greater flexibility of how the contradirectional polar pattern of the contradirectional audio input signal may be oriented, as will be illustrated and described in more detail below.

System 100 may be configured to perform the operations of method 200 in any of the ways described above, as well as to perform other suitable operations as may serve a particular implementation. To this end, system 100 may include or be implemented by a processor housed within housing 302 and communicatively coupled to the plurality of microphone elements 308 and wireless communication interface 304. In this configuration, the processor may be configured to generate a contradirectional audio input signal, generate an array of multidirectional audio input signals, generate a weighted audio input signal by mixing the array of multidirectional audio input signals, generate a stereo audio output signal based on the contradirectional audio input signal and the weighted audio input signal, and wirelessly transmit (e.g., by way of wireless communication interface 304 to hearing device 310) the stereo audio output signal for presentation to listener 312 by hearing device 310.

Hearing device 310 may be implemented by any device configured to provide or enhance hearing to listener 312. For example, a hearing device may be implemented by a binaural hearing aid system configured to amplify audio content to listener 312, a binaural cochlear implant system configured to apply electrical stimulation representative of audio content to listener 312, a sound processor included in an electroacoustic stimulation system configured to apply electrical and acoustic stimulation to listener 312, or any other suitable hearing prosthesis or combination of hearing prostheses. In some examples, a hearing device may be implemented by a behind-the-ear ("BTE") component configured to be worn behind an ear of listener 312. In some examples, a hearing device may be implemented by an in-the-ear ("ITE") component configured to at least partially be inserted within an ear canal of listener 312. In some examples, a hearing device may include a combination of an ITE component, a BTE component, and/or any other suitable component.

Figure 4:
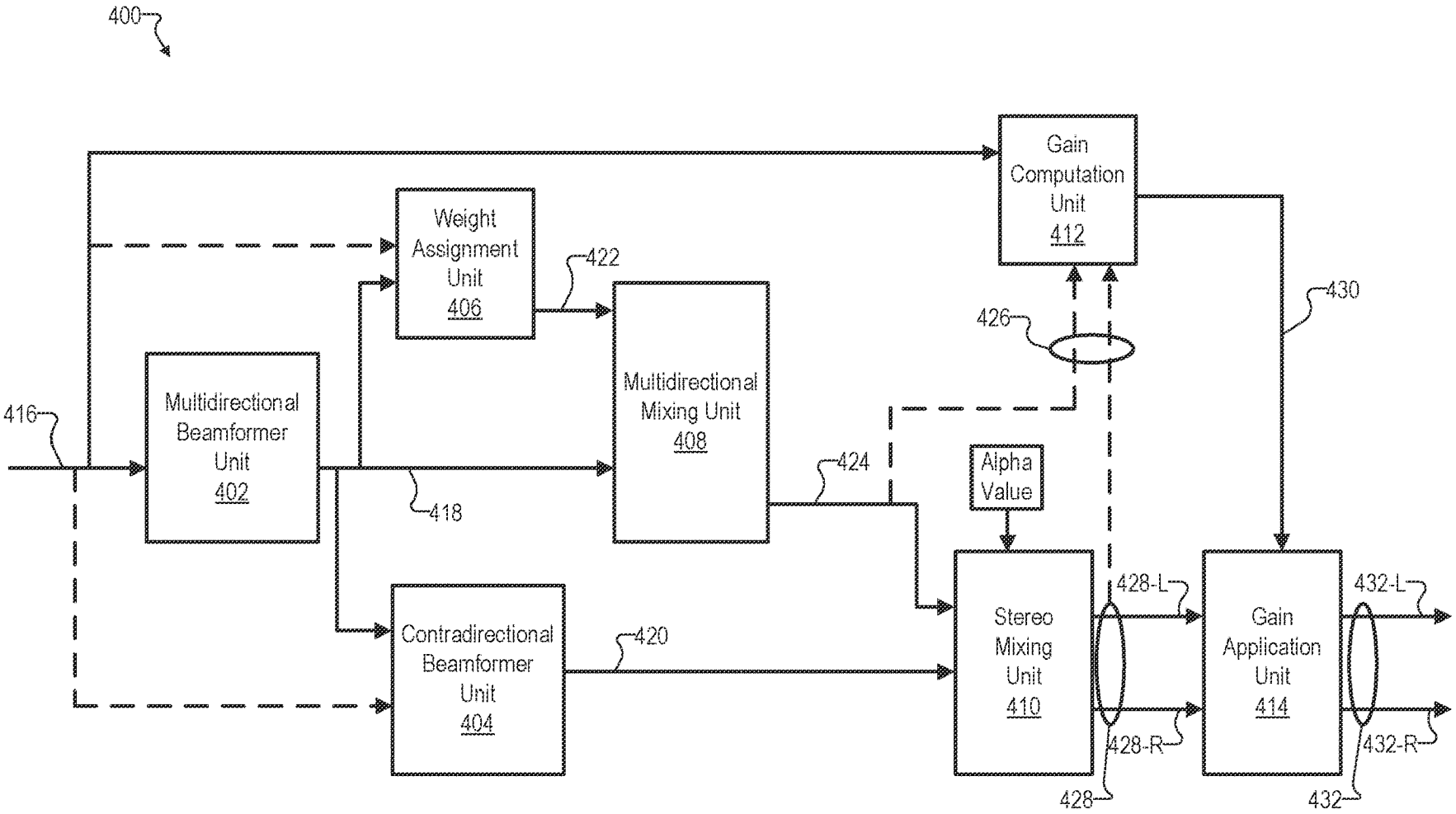
FIG. 4 shows an illustrative block diagram of functional units configured to implement the stereo rendering system of FIG. 1 according to principles described herein.

FIG. 4 shows an illustrative block diagram 400 of functional units 402-414 that are configured to implement system 100 in accordance with principles described herein. Specifically, as shown, the implementation illustrated by block diagram 400 includes a multidirectional beamformer unit 402, a contradirectional beamformer unit 404, a weight assignment unit 406, a multidirectional mixing unit 408, a stereo mixing unit 410, a gain computation unit 412, and a gain application unit 414. Each of units 402 through 414 will be understood to be communicatively coupled to one another so as to input, output, and exchange various signals 416 through 432. In some examples, each of units 402 through 414 (or subgroups of these units) may be implemented by separate hardware devices and/or circuitry (e.g., processors and/or other electronic circuitry, etc.) included within system 100. In other examples, each of these units may be implemented as a software module that is performed by a single processor (e.g., processor 104), such that each of units 402 through 414 are performed by the same processor.

The operation of this implementation of system 100 will now be described in relation to the role of each of units 402 through 414. In particular, the function to be performed by each unit will be described with reference to input and output signals of each unit (i.e., signals 416 through 432), as well as with reference to FIGS. 5 through 8, which illustrate various additional aspects of the operations performed and outcomes achieved by the functional units represented in FIG. 4.

Multidirectional beamformer unit 402 may receive a plurality of audio input signals 416 as input, and may perform beamforming operations using audio input signals 416 to generate an array of multidirectional audio input signals 418 that are output to weight assignment unit 406, multidirectional mixing unit 408, and/or contradirectional beamformer unit 404. In this way, system 100 may obtain the array of multidirectional audio input signals 418, as described above in relation to operation 204 of method 200.

In one illustrative implementation, microphone assembly 306 may have at least three omnidirectional microphone elements 308-1 in the plurality of microphone elements 308. In this implementation, the obtaining of the array of multidirectional audio input signals may include a beamforming operation that uses audio input signals 416 captured by the at least three omnidirectional microphone elements 308-1 to generate at least six multidirectional audio input signals 418 for the array of multidirectional audio input signals 418. For example, the at least six multidirectional audio input signals 418 may be distributed to point along every 60° angle of a full 360° angle in the horizontal plane.

Figure 5:
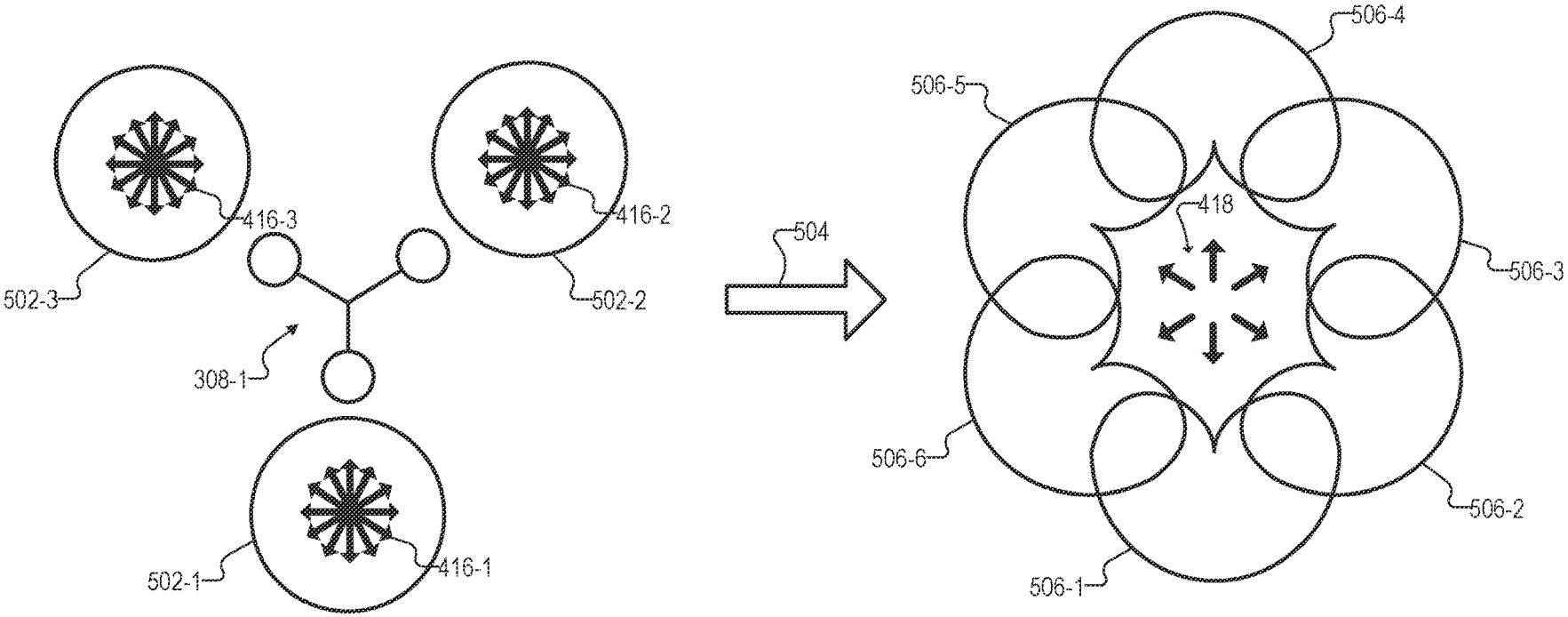
FIG. 5 shows illustrative aspects of how multidirectional audio input signals may be generated according to principles described herein.

To illustrate this example of how multidirectional beamformer unit 402 may function, FIG. 5 shows illustrative aspects of how multidirectional audio input signals 418 may be generated. Specifically, as shown in FIG. 5, omnidirectional microphone elements 308-1 may capture individual omnidirectional audio input signals 416 (e.g., audio input signals 416-1 through 416-3) in accordance with omnidirectional polar patterns 502 (e.g., polar patterns 502-1 through 502-3 for the different microphone elements 308-1). As such, sound coming from any source around a 360° angle with respect to the arrangement of microphone elements 308-1 may be captured by each of the microphone elements as a result of the omnidirectionality of polar patterns 502.

The function of multidirectional beamformer unit 402 is represented in FIG. 5 by an arrow 504 between the representation of microphone elements 308-1 (with their respective audio input signals 416 and polar patterns 502) and a representation of multidirectional audio input signals 418. Whereas the omnidirectional audio input signals 416 are shown to capture from all directions (represented by arrows pointing in various directions from a center point), multidirectional audio input signals 418 are illustrated as individual arrows pointing radially outward from a center point to indicate the general direction in which each multidirectional audio input signal 418 is directed. Around multidirectional audio input signals 418, respective unidirectional polar patterns 506 (e.g., unidirectional polar patterns 506-1 through 506-6) indicate the respective unidirectional polar patterns that are associated with multidirectional audio input signals 418. As illustrated, unidirectional polar patterns 506 are collectively omnidirectional in the horizontal plane.

Returning to FIG. 4, contradirectional beamformer unit 404 may receive multidirectional audio input signals 418 as input, and may perform beamforming operations using multidirectional audio input signals 418 to generate a contradirectional audio input signal 420 that is output to stereo mixing unit 410. In this way, system 100 may obtain contradirectional audio input signal 420, as described above in relation to operation 202 of method 200. As illustrated by a dashed line, contradirectional beamformer unit 404 may optionally input audio input signals 416 and use these to derive contradirectional audio input signal 420 (e.g., in addition or as an alternative to inputting and using multidirectional audio input signals 418). Additionally, as mentioned above, other implementations of contradirectional audio input signals may be obtained directly from a contradirectional microphone element (e.g., microphone element 308-2) such that the beamforming operation performed by contradirectional beamformer unit 404 might not be required.

Figure 6B:
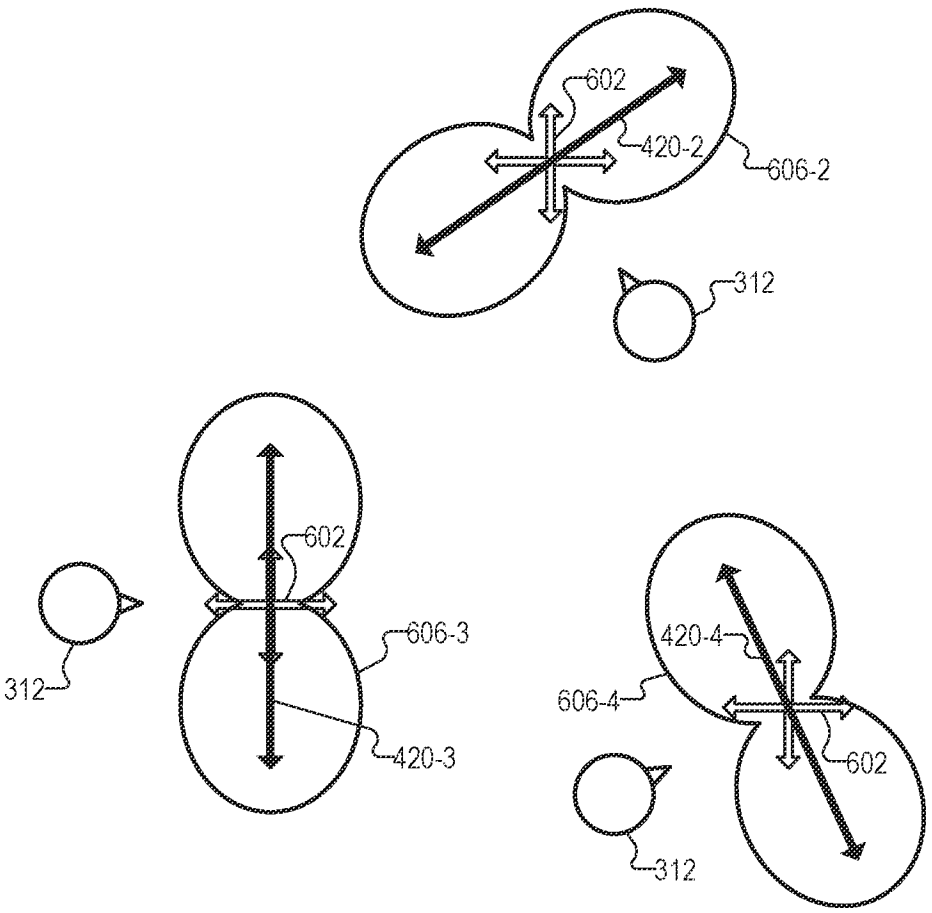
FIGS. 6A and 6B show illustrative aspects of how contradirectional audio input signals may be generated according to principles described herein.
Figure 6A:
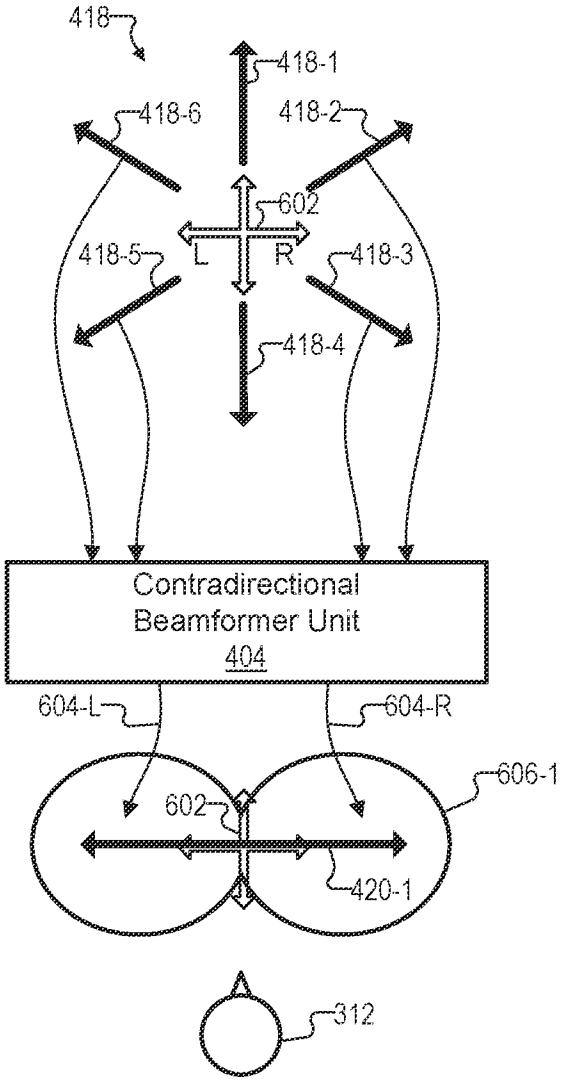

To illustrate an example of the beamforming that system 100 may perform to derive a contradirectional audio input signal, FIGS. 6A and 6B show illustrative aspects of how contradirectional beamformer unit 404 may generate contradirectional audio input signals based on audio input signals such as multidirectional audio input signals 418 (e.g., individually labeled as multidirectional audio input signals 418-1 through 418-6 in FIG. 6A). The examples described in relation to FIGS. 6A and 6B show different implementations of contradirectional audio input signal 420 that are derived based on multidirectional audio input signals 418. Specifically, the example of FIG. 6A shows a contradirectional audio input signal 420-1, while FIG. 6B shows several other examples labeled as contradirectional audio input signals 420-2 through 420-4. While these examples are derived based on multidirectional audio input signals 418, it will be understood that similar beamforming operations may be performed in certain implementations to derive equivalent (e.g., the same or similar) contradirectional audio input signals 420 based on audio input signals 416 instead of or in addition to multidirectional audio input signals 418.

In certain implementations, the obtaining of a contradirectional audio input signal 420 includes deriving the contradirectional audio input signal by way of a beamforming operation using a static subset of the array of multidirectional audio input signals 418. For instance, this type of implementation is shown in FIG. 6A, where the static subset is shown to include multidirectional audio input signals 418-2, 418.3, 418-5, and 418-6.

In the example of FIG. 6A, a coordinate reference icon 602 is shown in the middle of multidirectional audio input signals 418 to illustrate how the directionality of these signals is oriented with respect to an environment. For example, coordinate reference icon 602 may represent an orientation of microphone assembly system 300 with respect to a table on which the microphone assembly system is positioned. In this example, the coordinates may be assumed to be oriented manually to line up with the listener, such that a fixed left ("L") and right ("R") associated with the listener may be assigned. For instance, this implementation may be designed with an assumption that microphone assembly system 300 is a portable device that the listener will set up and align properly on the table in front of himself or herself.

In this example, contradirectional beamformer unit 404 may generate a left component 604-L of contradirectional audio input signal 420-1 based on a combination of multidirectional audio input signals 418-5 and 418-6, and may generate a right component 604-R of contradirectional audio input signal 420-1 based on a combination of multidirectional audio input signals 418-2 and 418-3, as shown. The output of contradirectional beamformer unit 404 is shown at the bottom of FIG. 6A to be contradirectional audio input signal 420-1, which is illustrated with respect to a contradirectional polar pattern 606-1. Contradirectional polar pattern 606-1 is shown to be oriented with respect to listener 312 (e.g., because of the way listener 312 manually aligned microphone assembly system 300). In some examples, the contradirectional audio input signal 420 generated by contradirectional beamformer unit 404 may generated in accordance with the following equation, in which $Signal_{420\text{-}1}$ represents contradirectional audio input signal 420-1, and in which $Signal_{418\text{-}2}$, $Signal_{418\text{-}3}$, $Signal_{418\text{-}5}$, and $Signal_{418\text{-}6}$ represent, respectively, multidirectional audio input signals 418-2, 418-3, 418-5, and 418-6:

$$Signal_{420-1} = \frac{1}{2}((Signal_{418-2} + Signal_{418-3}) - (Signal_{418-5} + Signal_{418-6}))$$

In some situations or for certain microphone assembly system implementations, it may not be that case that listener 312 is able to manually align microphone assembly system 300 such that the fixed subset of multidirectional audio input signals 418 can be used to generate a contradirectional audio input signal 420 aligned to the listener. For instance, if an implementation of microphone assembly system 300 is part of a conference phone or a permanent fixture on a conference table, it may not be convenient or desirable to have to physically realign the microphone assembly system before every meeting depending on where listener 312 happens to be sitting in the conference room. Additionally, even if microphone assembly system 300 is implemented as a portable device that is easily realignable by listener 312, it may be advantageous for microphone assembly system 300 to have at least some ability to automatically realign itself, especially if beamforming is being used to generate the contradirectional audio input signal 420 (rather than the signal being an output of a physical contradirectional microphone element).

Accordingly, in such situations and implementations, system 100 may be configured to determine a position of listener 312 with respect to an orientation of the microphone assembly and, based on that orientation, to identify a dynamic subset of the array of multidirectional audio input signals 418 that collectively capture audio signals implementing a contradirectional polar pattern that is oriented with respect to listener 312. The obtaining of the contradirectional audio input signal 420 may then include deriving the contradirectional audio input signal 420 by way of a beamforming operation using the dynamic subset of the array of multidirectional audio input signals 418.

To illustrate a few examples, FIG. 6B shows various scenarios where orientation reference icon 602 stays the same (e.g., representing that the orientation of microphone assembly system 300 is not changed from the example of FIG. 6A), but different implementations of contradirectional audio input signal 420 (i.e., contradirectional audio input signals 420-2, 420-3, and 420-4) are generated to implement different polar patterns 606 (i.e., contradirectional polar patterns 606-2, 606-3, and 606-4). As shown, each polar pattern 606 is oriented with respect to a different position of listener 312 with respect to orientation reference icon 602 (e.g., representing different seats at the table that listener 312 may choose to sit in, etc.). Contradirectional beamformer unit 404 may input any suitable dynamic subset of multidirectional audio input signals 418, and may combine the signals in any suitable way to generate the different contradirectional audio input signals 420. For example, using a similar notation as above, contradirectional beamformer unit 404 may use the following equation to generate contradirectional audio input signal 420-2:

$$Signal_{420-2} = \frac{1}{2}((Signal_{418-5}) - (Signal_{418-2}))$$

Contradirectional beamformer unit 404 may use the following equation to generate contradirectional audio input signal 420-3:

$$Signal_{420-3} = \frac{1}{2}((Signal_{418-1}) - (Signal_{418-4}))$$

Contradirectional beamformer unit 404 may use the following equation to generate contradirectional audio input signal 420-4:

$$Signal_{420-4} = \frac{1}{2}((Signal_{418-1} + Signal_{418-6}) - (Signal_{418-3} + Signal_{418-4}))$$

In like manner, contradirectional beamformer unit 404 may use similar equations to generate various other contradirectional audio input signals 420 to align an orientation of the contradirectional polar pattern 606 with listener 312 regardless of where listener 312 is positioned with respect to microphone assembly system 300 (i.e., with respect to orientation reference icon 602).

In examples like those illustrated in FIG. 6B, system 100 may automatically determine the position of listener 312 with respect to the orientation of the microphone assembly (e.g., with respect to orientation reference icon 602) in any suitable manner. For instance, one implementation may involve 1) identifying, within sound represented by the array of multidirectional audio input signals 418, a voice of listener 312 when listener 312 speaks; 2) determining, based on the identification of the voice of listener 312, a particular multidirectional audio input signal 418 in the array that has a higher real-time signal-to-noise ratio with respect to the voice of listener 312 than other multidirectional audio input signals 418 in the array; and 3) determining the position of listener 312 based on the particular multidirectional audio input signal 418 in the array that has been determined to have a higher real-time signal-to-noise ratio with respect to the voice of 312 listener.

To illustrate how this approach may work with respect to a specific example, contradirectional audio input signal 420-4 of FIG. 6B will be considered. In this example, system 100 may analyze sound from each of the multidirectional audio input signals 418 and, within that sound, may recognize (e.g., based on voice recognition technologies, machine learning or artificial intelligence technologies, etc.) the voice of listener 312. System 100 may identify that multidirectional audio input signal 418-5 has a higher real-time signal-to-noise ratio with respect to the voice of listener 312 than any of the other multidirectional audio input signals 418 (e.g., because listener 312 is positioned such that the polar pattern of multidirectional audio input signals 418-5 is directed more squarely at listener 312 than any other polar pattern). Consequently, system 100 may determine that listener 312 is positioned as shown in FIG. 6B and may select the equation for $Signal_{420\text{-}4}$ above to generate the contradirectional audio input signal.

In other examples, the position of listener 312 may be determined in any other suitable way. For instance, rather than or in addition to voice recognition, a manual selection method may be used to indicate the listener's position (e.g., pressing a button on microphone assembly system 300, using a remote control, etc.), a spoken instruction or keyword may be used, visual examination may be used, or the like.

It will be understood that a contradirectional audio input signal generated in the ways described above with respect to FIGS. 6A and 6B may have a 6 dB lower white noise gain performance. Accordingly, in order to suppress the additional noise introduced, a high-pass filter may be applied to any of the contradirectional audio input signals 420 described herein.

Returning to FIG. 4, weight assignment unit 406 may receive multidirectional audio input signals 418 as input, and may determine weight values 422 for multidirectional audio input signal 418 that are output to multidirectional mixing unit 408. As illustrated by a dashed line, weight assignment unit 406 may optionally input audio input signals 416 and use these to derive weight values 422 (e.g., in addition or as an alternative to inputting and using multidirectional audio input signals 418).

Weight assignment unit 406 may assign respective weight values 422 to each of multidirectional audio input signals 418 in any suitable manner. For instance, in certain implementations, weight assignment unit 406 may be configured to 1) identify a particular multidirectional audio input signal 418 in the array that has a real-time signal-to-noise ratio higher, at a particular time, than real-time signal-to-noise ratios of other multidirectional audio input signals 418 in the array; 2) assign, based on the identifying and for the particular time, a unity weight value to the particular multidirectional audio input signal; and 3) assign, based on the identifying and for the particular time, respective weight values less than the unity weight value and greater than a null value to the other multidirectional audio input signals in the array.

To identify the multidirectional audio input signal 418 with the highest signal-to-noise ratio for a particular time (e.g., a particular moment in time, a particular duration of time, etc.) weight assignment unit 406 may estimate respective signal-to-noise ratios of each multidirectional audio input signal 418 in any suitable way. For example, weight assignment unit 406 may process (e.g., clean, filter, etc.) each signal using sound processing or sound cleaning techniques such as anti-shock, noise cancellation, or the like. Weight assignment unit 406 may then measure the signal-to-noise ratio of each multidirectional audio input signal 418 by combining two averagers with different time constants, one tracking the onsets of speech and the other one tracking the background noise. Based on the signal-to-noise ratio determine for each multidirectional audio input signal 418, weight assignment unit 406 may then determine which of the multidirectional audio input signals 418 has the highest signal-to-noise ratio (or, in certain examples, which plurality of multidirectional audio input signals 418 tie or substantially tie for having the highest signal-to-noise ratios).

A specific example is considered in which listener 312 is oriented with respect to multidirectional audio input signals 418 as was shown in FIG. 6A, and a primary speaker 318 at a particular moment in time is located directly in front of listener 312 in the direction of multidirectional audio input signal 418-1. In this example, weight assignment unit 406 may identify that multidirectional audio input signal 418-1 has a higher real-time signal-to-noise ratio than any of the other multidirectional audio input signals 418 (i.e., multidirectional audio input signals 418-2 through 418-6). Based on this identification of multidirectional audio input signal 418-1 for this particular time (e.g., a period of time during which this particular speaker 318 has the floor and is speaking louder than any other sound source), weight assignment unit 406 may assign a unity weight value to multidirectional audio input signal 418-1. For example, the unity weight value may be 0 dB (i.e., no attenuation), or any other suitable amount of gain or attenuation (e.g., 6 dB, −6 dB, etc.) as may serve a particular implementation. Because multidirectional audio input signal 418-1 was determined to have the highest signal-to-noise ratio, the unity weight value assigned may be higher than weight values assigned to the other multidirectional audio input signals 418 at this time. For instance, based on the identification of multidirectional audio input signal 418-1 for the particular time, weight assignment unit 406 may further assign other respective weight values less than the unity weight value but greater than a null weight value to multidirectional audio input signals 418-2 through 418-6. For example, if the unity weight value is 0 dB, then the null weight value may be negative infinity dB (−∞ dB), which would have the effect of attenuating the signal to complete silence. Accordingly, −20 dB or another non-null minimum weight value may be assigned to the other respective weight values such that they will not be completely omitted, but merely deemphasized, from the weighted audio input signal that is to be generated by multidirectional mixing unit 408 as described in more detail below.

In certain examples, a multidirectional audio input signal 418 with the highest signal-to-noise ratio may be assigned the unity weight value (e.g., 0 dB) while the other multidirectional audio input signals 418 may be assigned a minimum weight values (e.g., a non-null value such as −20 dB or another suitable value). In other examples, however, it may be undesirable for the emphasized multidirectional audio input signal 418 to change as abruptly as this type of implementation would cause it to change. For example, in a back and forth dialogue between two speakers, it may be disorienting or distracting for the emphasis to abruptly change back and forth nearly instantaneously. Accordingly, in certain implementations, weight assignment unit 406 may be configured to immediately (e.g., with a relatively fast attack time of a few milliseconds) assign a new signal the unity weight value when it comes to have the highest signal-to-noise ratio, but, rather than immediately dropping the weight values of signals that previously had the highest signal-to-noise ratio (i.e., for previous times), weight assignment unit 406 may be configured to gradually (e.g., with a relatively slow release time of a full second or several seconds) drop the weight values of the other multidirectional audio input signals 418 until a minimum weight value (e.g., a null minimum weight value such as −∞ dB, a non-null minimum weight value such as −20 dB, etc.) is reached. The other multidirectional audio input signals 418 may then remain at the minimum weight value until they are identified as again having the highest signal-to-noise ratio, at which point they may again be immediately reset to the unity value.

Figure 7:
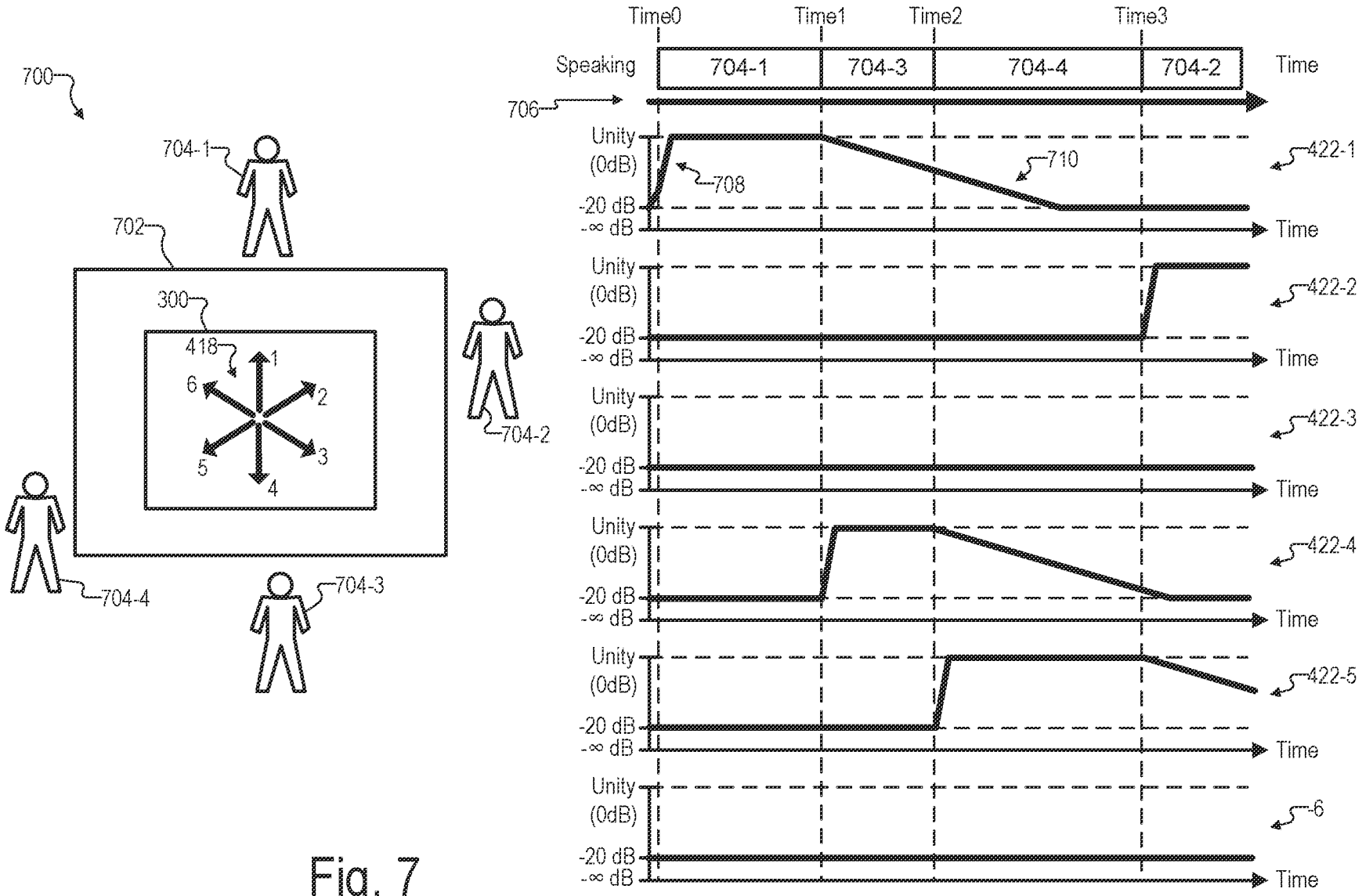
FIG. 7 shows an illustrative hearing scenario and how respective weight values may be assigned to multidirectional audio input signals generated in the hearing scenario according to principles described herein.

To illustrate, FIG. 7 shows an example hearing scenario 700 and how respective weight values 422 may be assigned to multidirectional audio input signals 418 generated in the hearing scenario in accordance with principles described herein. Specifically, as shown, a table 702 (e.g., conference room table, a table used for eating, etc.) is depicted in hearing scenario 700 to include a microphone assembly system 300 (e.g., a table microphone device that a listener has placed on table 702). Multidirectional audio input signals 418 are shown with numbered arrows in FIG. 7 to illustrate the directionality of each of these signals with respect to microphone assembly system 300 and various speakers 704 (e.g., speakers 704-1 through 704-4) around table 702. For instance, speakers 704 may be various people in a meeting or having a meal or round table discussion with the listener (who is not explicitly shown).

Next to hearing scenario 700, a timeline 706 is presented alongside respective weight values 422 (e.g., weight values 422-1 through 422-6) for each of multidirectional audio input signals 418. Each weight value 422 is illustrated as a solid bold line that is drawn on a graph with time as the x-axis and a weight value (e.g., between a null weight value of −∞ dB and a unity weight value of 0 dB) as the y-axis. Along timeline 706, different moments in time are labeled as Time0, Time1, Time2, and Time3. Timeline 706 illustrates that, at these labeled moments in time, a speaker 704 who is speaking (or speaking the loudest so as to produce a multidirectional audio input signal 418 with the highest signal-to-noise ratio) changes. Specifically, as shown, speaker 704-1 is shown to be the primary speaker starting at Time0, speaker 704-3 becomes the primary speaker starting at Time1, speaker 704-4 becomes the primary speaker starting at Time2, and speaker 704-2 becomes the primary speaker starting at Time3.

As described above, the weight value 422 most closely associated with the speaker 704 who is the primary speaker at a given moment in time may be immediately set to the unity value and may stay there until a new primary speaker is identified, at which point the weight value 422 may gradually drop off until reaching a non-null minimum weight value (e.g., −20 dB in this example). Specifically, for example, weight value 422-1, which is associated with multidirectional audio input signal 418-1 (i.e., the multidirectional audio input signal most closely directed toward speaker 704-1), is shown to quickly ramp up from the minimum weight value (−20 dB) to the unity weight value (0 dB) at Time 0 when speaker 704-1 begins speaking as the primary speaker. Weight value 422-1 remains at the unity value until Time1 when speaker 704-1 is no longer the primary speaker. At Time1, weight value 422-1 is shown to begin gradually decreasing from the unity weight value back toward the minimum weight value as weight value 422-4 (the weight value most closely associated with speaker 704-3) immediately ramps up from the minimum weight value to the unity weight value.

As labeled specifically with respect to weight value 422-1 (and as similarly shown, though not labeled, by the other weight values 422), an attack time 708 during which weight value 422-1 ramps up may be significantly faster (e.g., more than twice as fast, an order of magnitude faster, a plurality of orders of magnitude faster, etc.) than a release time 710 during which weight value 422-1 drops off. For example, while attack time 708 may be instantaneous or just a few milliseconds (e.g., 10 ms, 100 ms, etc.), release time 708 may be on the order of seconds or more (e.g., 1 s, 5 s, etc.). It will be understood that timing relationships depicted in FIG. 7 are not necessarily drawn to scale. These types of time constraints, with relatively fast attack times and slow release times, may help ensure smooth transitions between speakers 704 with respect to what signals are emphasized in the weighted audio input signal 424. Due to the relatively slow release times, multiple signals may, at a particular moment in time (e.g., see a moment soon after Time 2 as one example), be assigned weight values 422 that are between the unity weight value and the minimum weight values. Weight values may go up and down from moment to moment based on which speakers are talking (or talking the loudest) around microphone assembly system 300 as illustrated by the different weight values 422 illustrated with respect to timeline 706 in FIG. 7.

Returning to FIG. 4, multidirectional mixing unit 408 may receive multidirectional audio input signals 418 and weight values 422 as input, and may generate a weighted audio input signal 424 as output that emphasizes the multidirectional audio input signal 418 with the highest signal-to-noise ratio (e.g., the signal associated with the primary speaker and having the weight value currently assigned the unity weight value) while deemphasizing, to varying degrees in some implementations, the other multidirectional audio input signals 418. Multidirectional mixing unit 408 may generate weighted audio input signal 424 by mixing the array of multidirectional audio input signals 418 in accordance with respective weight values 422 assigned to each multidirectional audio input signal in the array by weight assignment unit 406. For instance, multidirectional mixing unit 408 may boost, maintain, or attenuate each multidirectional audio input signal 418 in accordance with its assigned weight value 422, then combine (e.g., mix, sum, etc.) these weighted signals together to produce weighted audio input signal 424.

Stereo mixing unit 410 may receive weighted audio input signal 424 and contradirectional audio input signal 420 as input, and may generate an intermediate stereo signal 428 as output that includes a left component (intermediate stereo signal 428-L) and a right component (intermediate stereo signal 428-R). Stereo mixing unit 410 may mix weighted audio input signal 424 and contradirectional audio input signal 420 to generate intermediate stereo signal 428 in any suitable manner. For example, stereo mixing unit 410 may utilize a mid-side mixing technique in which weighted audio input signal 424 is used as the mid signal (e.g., in place of a cardioid or omnidirectional signal as may be conventionally used in a mid-side mixing technique) while contradirectional audio input signal 420 may be used as the side signal that adds a stereo component to the mid signal. More specifically, for example, the following equations may be used in which $\text{Signal}_{428\text{-}L}$ and $\text{Signal}_{428\text{-}R}$ respectively represent intermediate stereo signals 428 output by stereo mixing unit 410, $Signal_{424}$ represents weighted audio input signal 424, and $Signal_{420}$ represents contradirectional audio input signal 420:

$$Signal_{428\text{-}L}=(Signal_{424}-Signal_{420})$$

$$Signal_{428\text{-}R}=(Signal_{424}+Signal_{420})$$

In certain examples, an alpha value ("Alpha Value" in FIG. 4) may also be accounted for by stereo mixing unit 410 to control the balance between contradirectional audio input signal 420 and weighted audio input signal 424 in the generation of intermediate stereo signal 428. For example, if the alpha value is set to a unity value (e.g., 1.0), intermediate stereo signal 428 may be based entirely on contradirectional audio input signal 420 and the stereo difference between signals 428-L and 428-R may be maximized. On the other extreme, if the alpha value is set to a null value (e.g., 0.0), intermediate stereo signal 428 may be based entirely on weighted audio input signal 424 and signals 428-L and 428-R may be identical (i.e., a monoaural signal). If the alpha value is set between these extremes (i.e., to a value between 0.0 and 1.0, such as 0.5), as may typically be the case, intermediate stereo signal 428 may be based on a mix of audio input signals 420 and 424 (an alpha value of 0.5 weight both signals equally).

Accordingly, it will be understood that in certain examples, the generating of the stereo audio output signal by system 100 may be performed in accordance with an alpha value configured to define a relative strength of contradirectional audio input signal 420 with respect to weighted audio input signal 424 as contradirectional audio input signal 420 and weighted audio input signal 424 are combined to generate the stereo audio output signal that will ultimately be derived from intermediate stereo signal 428. In certain implementations, the alpha value may be fixed at a predetermined value such as 0.5 that has been determined to be suitable under a wide variety of circumstances. In other implementations, however, system 100 may automatically and dynamically change the alpha value based on run time conditions. For example, the alpha value may be dynamically modified during runtime based on a preference of the listener (e.g., how much stereo the listener indicates that he or she wishes to hear), and/or based on a runtime condition associated with sound being captured by the microphone assembly (e.g., based on how noisy the room is detected to be, what type of sound is being captured, a detected noise floor, etc.). For example, it may be more appropriate in a quiet room for the listener to be provided a signal that has a heavy stereo component (e.g., a relatively high alpha value), whereas so much stereo may make it difficult to understand speech in a noise room (e.g., thereby calling for a relatively low alpha value).

The generating of the stereo audio output signal by system 100 may, in certain examples, include: 1) determining, based on at least one of a predefined preference of the listener or a runtime condition associated with sound being captured by the microphone assembly, a gain to be applied to the stereo audio output signal for presentation to the listener; 2) combining contradirectional audio input signal 420 and weighted audio input signal 424 to generate intermediate stereo signal 428 (as described above); and 3) applying the gain to intermediate stereo signal 428 to generate the stereo audio output signal for presentation to the listener.

To illustrate, FIG. 4 shows that gain computation unit 412 may receive audio input signals 416 (as well as, optionally, other signals 426 such as weighted audio input signal 424 and/or intermediate stereo signal 428) and may generate one or more gain parameters 430 representative of gain that is to be applied to intermediate stereo signal 428 to generate the stereo audio output signal. Gain computation unit 412 may generate any type of gain parameters 430 for any purpose as may serve a particular implementation. For example, gain parameters may be associated with noise cancellation (e.g., to cancel fan noise from microphone assembly system 300 or ambient noise detected to be present in the environment, etc.), dynamic range compression for the stereo signal, equalization or other processing for the stereo signal, or for any other purpose. In some examples, gain computation unit 412 may calculate dynamic gain parameters 430 based on three audio input signals 416, which may include a gain model with expansion, linear, and compression parts (dynamic range), as well as noise cancelling algorithms (for fan noise, etc.). In some examples, the determination of gain parameters 430 is performed in the frequency domain so that the applied gain will be a vector that may be shaped with respect to various individual frequency components of the stereo output signal.

Gain application unit 414 may receive intermediate stereo signal 428 and gain parameters 430 as input, and may generate a stereo output signal 432 that includes a left component (stereo output signal 432-L) and a right component (stereo output signal 432-R). Gain application unit 414 may apply gain parameters 430 to intermediate stereo signal 428 (e.g., in the frequency domain, as described above) and/or perform any other suitable processing to generate stereo output signal 432. Stereo output signal 432 may then be provided for wireless transmission to a hearing device (e.g., to hearing device 310 by way of wireless communication interface 304, as described above in relation to FIG. 3). As a result, the listener may receive a signal that both emphasizes primary sounds based on dynamic tracking while also being rendered in stereo to assist the listener in localization in voice distinguishing efforts in the ways described above.

Figure 8B:
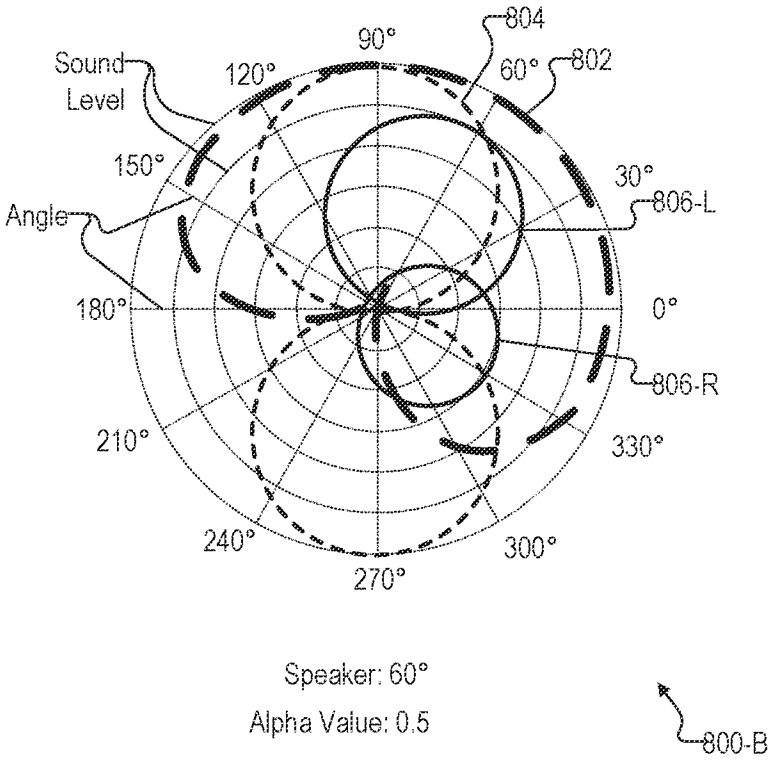
FIGS. 8A and 8B show illustrative polar pattern diagrams of input and output signals received and generated under different circumstances by stereo rendering systems and methods according to principles described herein.
Figure 8A:
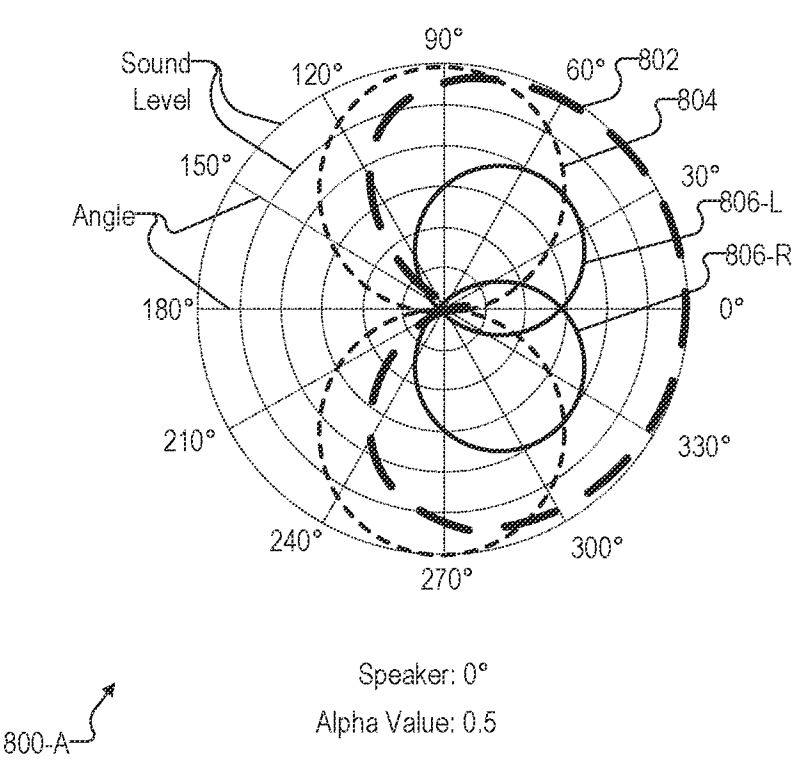

To illustrate this final output that is generated, FIGS. 8A and 8B show illustrative polar pattern diagrams 800-A and 800-B of input and output signals received and generated under different circumstances by stereo rendering systems and methods described herein such as system 100 and method 200. Specifically, FIG. 8A shows polar pattern diagrams 800-A for a moment in time when the primary speaker is oriented at 0° and the alpha value is 0.5 (i.e., so as to equally mix stereo and weighted signals). FIG. 8B shows polar pattern diagrams 800-B for a different moment in time when the primary speaker is oriented at 60° and the alpha value is also 0.5.

In both polar pattern diagrams 800 (i.e., polar pattern diagrams 800-A and 800-B), a unidirectional polar pattern 802 represents the directionality of weighted audio output signal 424 and a contradirectional polar pattern 804 represents the directionality of contradirectional audio input signal 420. Additional unidirectional polar patterns 806-L and 806-R then represent the directionality of left and right components of stereo audio output signal 432.

As shown in FIG. 8A, because the speaker is directly in front of the listener (i.e., at 0°) and the alpha value is 0.5, polar patterns 806-L and 806-R are facing at 45° and −45° (i.e., 330°) so as to be equally forward-facing toward the sound source while also providing a sense of stereo. If the alpha value were higher, the polar patterns would be directed further outwards (i.e., closer to 90° and −90°) whereas if the alpha value were lower, the polar patterns would be directed further inward (i.e., closer to 0°). As shown, polar patterns 806-L and 806-R are each shown to be the same relative magnitude, indicating that both ears of the listener will be presented with the primary sound at an identical level (thereby creating an ILD cue indicating that the primary sound originates directly in front of the listener).

As shown in FIG. 8B, because the speaker is to the left of the listener (i.e., at 60°) and the alpha value is 0.5, polar patterns 806-L and 806-R are each turned to face more to the listener's left (i.e., at 60° for the left signal and at −30° (330°) for the right signal), so as to be directed to the left while still providing the sense of stereo. In contrast to the example of FIG. 8A, in this example, polar patterns 806-L and 806-R are also each shown to have different relative magnitudes (i.e., polar pattern 806-L is larger than polar pattern 806-R), indicating that both ears of the listener will be presented with the primary sound at different levels (thereby creating an ILD cue indicating that the primary sound originates at 60° to the left of the listener).

In certain implementations, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory (DRAM), which typically constitutes a main memory. Common forms of computer-readable media include, for example, a disk, hard disk, magnetic tape, any other magnetic medium, a compact disc read-only memory (CD-ROM), a digital video disc (DVD), any other optical medium, random access memory (RAM), programmable read-only memory (PROM), electrically erasable programmable read-only memory (EPROM), FLASH-EEPROM, any other memory chip or cartridge, or any other tangible medium from which a computer can read.

Figure 9:
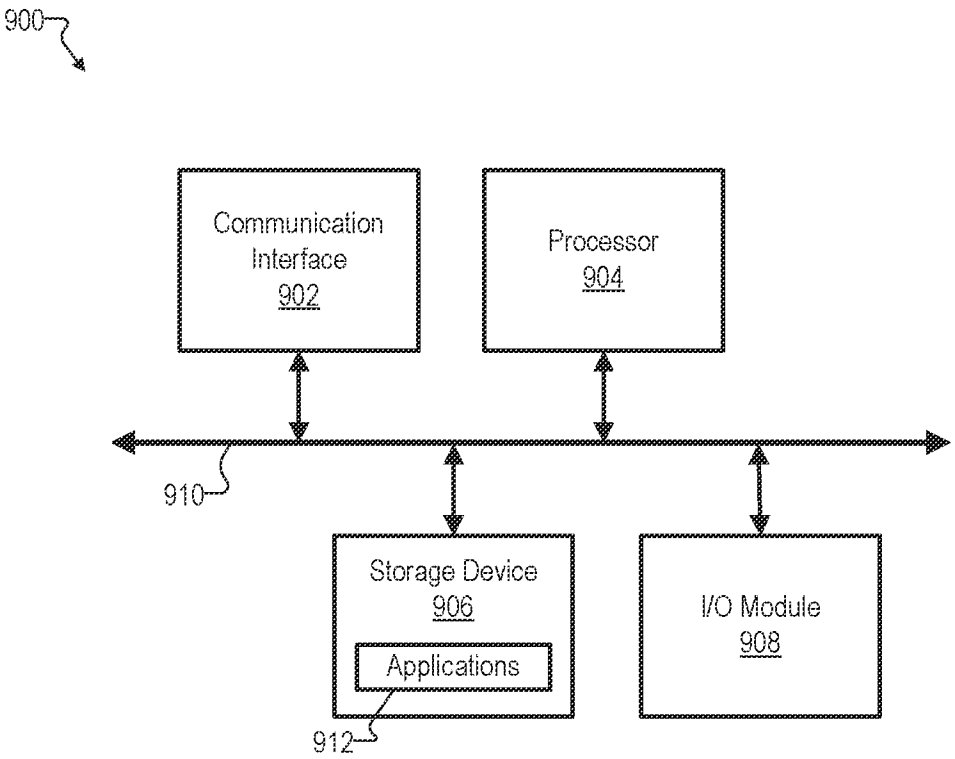
FIG. 9 shows an illustrative computing system that may implement any of the computing systems or devices described herein.

FIG. 9 shows an illustrative computing system that may implement any of the computing systems or devices described herein. For example, computing system 900 may include or implement (or partially implement) a stereo rendering system such as system 100 or any component or processing unit included therein or system associated therewith.

As shown in FIG. 9, computing system 900 may include a communication interface 902, a processor 904, a storage device 906, and an input/output (I/O) module 908 communicatively connected via a communication infrastructure 910. While an illustrative computing system 900 is shown in FIG. 9, the components illustrated in FIG. 9 are not intended to be limiting. Additional or alternative components may be used in other implementations. Components of computing system 900 shown in FIG. 9 will now be described in additional detail.

Communication interface 902 may be configured to communicate with one or more computing devices. Examples of communication interface 902 include, without limitation, a wired network interface (such as a network interface card), a wireless network interface (such as a wireless network interface card), a modem, an audio/video connection, and any other suitable interface.

Processor 904 generally represents any type or form of processing unit capable of processing data or interpreting, executing, and/or directing execution of one or more of the instructions, processes, and/or operations described herein. Processor 904 may direct execution of operations in accordance with one or more applications 912 or other computer-executable instructions such as may be stored in storage device 906 or another computer-readable medium.

Storage device 906 may include one or more data storage media, devices, or configurations and may employ any type, form, and combination of data storage media and/or device. For example, storage device 906 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 906. For example, data representative of one or more executable applications 912 configured to direct processor 904 to perform any of the operations described herein may be stored within storage device 906. In some examples, data may be arranged in one or more databases residing within storage device 906.

I/O module 908 may include one or more I/O modules configured to receive user input and provide user output. One or more I/O modules may be used to receive input for a single virtual experience. I/O module 908 may include any hardware, firmware, software, or combination thereof supportive of input and output capabilities. For example, I/O module 908 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 908 may include one or more devices for presenting output to a user, including, but not limited to, a graphics engine, a display (e.g., a display screen), one or more output drivers (e.g., display drivers), one or more audio speakers, and one or more audio drivers. In certain implementations, I/O module 908 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing system 900. For example, one or more applications 912 residing within storage device 906 may be configured to direct processor 904 to perform one or more processes or functions associated with processor 104 of system 100. Likewise, memory 102 of system 100 may be implemented by or within storage device 906.

In the preceding description, various illustrative embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a memory storing instructions; and a processor communicatively coupled to the memory and configured to execute the instructions to:

obtain a contradirectional audio input signal generated by a microphone assembly having a plurality of microphone elements, the contradirectional audio input signal implementing a contradirectional polar pattern oriented with respect to a listener;

obtain an array of multidirectional audio input signals generated by the microphone assembly, the array of multidirectional audio input signals implementing different unidirectional polar patterns that are collectively omnidirectional in a horizontal plane;

generate a weighted audio input signal by mixing the array of multidirectional audio input signals in accordance with respective weight values assigned to each multidirectional audio input signal in the array based on a respective real-time signal-to-noise ratio of each multidirectional audio input signal in the array; and generate, based on the contradirectional audio input signal and the weighted audio input signal and in accordance with an alpha value, a stereo audio output signal for presentation to the listener, wherein the alpha value is configured to define a relative strength of the contradirectional audio input signal with respect to the weighted audio input signal as the contradirectional audio input signal and the weighted audio input signal are combined to generate the stereo audio output signal.

2. The system of claim 1, wherein:

the microphone assembly has at least three microphone elements in the plurality of microphone elements; and the obtaining of the array of multidirectional audio input signals includes a beamforming operation that uses audio signals captured by the at least three microphone elements to generate at least six multidirectional audio input signals for the array of multidirectional audio input signals.

3. The system of claim 1, wherein the generating of the weighted audio input signal includes assigning the respective weight values to each of the multidirectional audio input signals in the array by:

identifying a particular multidirectional audio input signal in the array that has a real-time signal-to-noise ratio higher, at a particular time, than real-time signal-to-noise ratios of other multidirectional audio input signals in the array;

assigning, based on the identifying and for the particular time, a unity weight value to the particular multidirectional audio input signal; and assigning, based on the identifying and for the particular time, respective weight values less than the unity weight value and greater than a null weight value to the other multidirectional audio input signals in the array.

4. The system of claim 1, wherein an attack time associated with a weight value assigned to a particular multidirectional audio input signal in the array is faster than a release time associated with the weight value assigned to the particular multidirectional audio input signal.

5. The system of claim 1, wherein the plurality of microphone elements of the microphone assembly includes:

at least three microphone elements configured to capture audio signals from which the array of multidirectional audio input signals is derived; and one or more microphone elements distinct from the at least three microphone elements and configured to capture one or more audio signals from which the contradirectional audio input signal is derived.

6. The system of claim 1, wherein the plurality of microphone elements of the microphone assembly includes at least three microphone elements configured to capture audio signals from which both the array of multidirectional audio input signals and the contradirectional audio input signal are derived.

7. The system of claim 1, wherein the obtaining of the contradirectional audio input signal includes deriving the contradirectional audio input signal by way of a beamforming operation using a static subset of the array of multidirectional audio input signals.

8. The system of claim 1, wherein:

the processor is further configured to execute the instructions to:

determine a position of the listener with respect to an orientation of the microphone assembly, and identify, based on the position of the listener with respect to the orientation of the microphone assembly, a dynamic subset of the array of multidirectional audio input signals that collectively capture audio signals implementing the contradirectional polar pattern oriented with respect to the listener; and the obtaining of the contradirectional audio input signal includes deriving the contradirectional audio input signal by way of a beamforming operation using the dynamic subset of the array of multidirectional audio input signals.

9. The system of claim 8, wherein the determining of the position of the listener with respect to the orientation of the microphone assembly includes:

identifying, within sound represented by the array of multidirectional audio input signals, a voice of the listener when the listener speaks;

determining, based on the identifying of the voice of the listener, a particular multidirectional audio input signal in the array that has a higher real-time signal-to-noise ratio with respect to the voice of the listener than other multidirectional audio input signals in the array; and determining the position of the listener based on the particular multidirectional audio input signal in the array that has been determined to have the higher real-time signal-to-noise ratio with respect to the voice of the listener.

10. The system of claim 1, wherein the alpha value is dynamically modified during runtime based on a predefined preference of the listener.

11. The system of claim 1, wherein the generating of the stereo audio output signal includes:

determining, based on at least one of a predefined preference of the listener or a runtime condition associated with sound being captured by the microphone assembly, a gain to be applied to the stereo audio output signal for presentation to the listener;

combining the contradirectional audio input signal and the weighted audio input signal to generate an intermediate stereo signal; and applying the gain to the intermediate stereo signal to generate the stereo audio output signal for presentation to the listener.

12. The system of claim 1, wherein the alpha value is dynamically modified during runtime based on a runtime condition associated with sound being captured by the microphone assembly.

13. A method comprising:

obtaining, by a stereo rendering system associated with a microphone assembly having a plurality of microphone elements, a contradirectional audio input signal generated by the microphone assembly and implementing a contradirectional polar pattern oriented with respect to a listener;

obtaining, by the stereo rendering system, an array of multidirectional audio input signals generated by the microphone assembly and implementing different unidirectional polar patterns that are collectively omnidirectional in a horizontal plane;

generating, by the stereo rendering system, a weighted audio input signal by mixing the array of multidirectional audio input signals in accordance with respective weight values assigned to each multidirectional audio input signal in the array based on a respective real-time signal-to-noise ratio of each multidirectional audio input signal in the array; and generating, by the stereo rendering system and based on the contradirectional audio input signal and the weighted audio input signal and in accordance with an alpha value, a stereo audio output signal for presentation to the listener, wherein the alpha value is configured to define a relative strength of the contradirectional audio input signal with respect to the weighted audio input signal as the contradirectional audio input signal and the weighted audio input signal are combined to generate the stereo audio output signal.

14. The method of claim 13, wherein:

the microphone assembly has at least three microphone elements in the plurality of microphone elements; and the obtaining of the array of multidirectional audio input signals includes a beamforming operation that uses audio signals captured by the at least three microphone elements to generate at least six multidirectional audio input signals for the array of multidirectional audio input signals.

15. The method of claim 13, wherein the generating of the weighted audio input signal includes assigning the respective weight values to each of the multidirectional audio input signals in the array by:

identifying a particular multidirectional audio input signal in the array that has a real-time signal-to-noise ratio higher, at a particular time, than real-time signal-to-noise ratios of other multidirectional audio input signals in the array;

assigning, based on the identifying and for the particular time, a unity weight value to the particular multidirectional audio input signal; and assigning, based on the identifying and for the particular time, respective weight values less than the unity weight value and greater than a null weight value to the other multidirectional audio input signals in the array.

16. The method of claim 13, wherein the plurality of microphone elements of the microphone assembly includes:

at least three microphone elements configured to capture audio signals from which the array of multidirectional audio input signals is derived; and one or more microphone elements distinct from the at least three microphone elements and configured to capture one or more audio signals from which the contradirectional audio input signal is derived.

17. The method of claim 13, wherein the plurality of microphone elements of the microphone assembly includes at least three microphone elements configured to capture audio signals from which both the array of multidirectional audio input signals and the contradirectional audio input signal are derived.

18. The method of claim 13, wherein the obtaining of the contradirectional audio input signal includes deriving the contradirectional audio input signal by way of a beamforming operation using a static subset of the array of multidirectional audio input signals.

19. The method of claim 13, wherein the alpha value is dynamically modified during runtime based on at least one of a predefined preference of the listener or a runtime condition associated with sound being captured by the microphone assembly.

20. A microphone assembly system comprising:

a housing;

a plurality of microphone elements;

a wireless communication interface configured to wirelessly transmit data from the housing to a hearing device separate from the microphone assembly system and worn by a listener; and a processor housed within the housing and communicatively coupled to the plurality of microphone elements and the wireless communication interface, the processor configured to:

generate, based on audio signals captured by the plurality of microphone elements, a contradirectional audio input signal that implements a contradirectional polar pattern oriented with respect to the listener;

generate, based on the audio signals captured by the plurality of microphone elements, an array of multidirectional audio input signals that implement different unidirectional polar patterns that are collectively omnidirectional in a horizontal plane;

generate a weighted audio input signal by mixing the array of multidirectional audio input signals in accordance with respective weight values assigned to each multidirectional audio input signal in the array based on a respective real-time signal-to-noise ratio of each multidirectional audio input signal in the array;

generate, based on the contradirectional audio input signal and the weighted audio input signal and in accordance with an alpha value, a stereo audio output signal, wherein the alpha value is configured to define a relative strength of the contradirectional audio input signal with respect to the weighted audio input signal as the contradirectional audio input signal and the weighted audio input signal are combined to generate the stereo audio output signal; and wirelessly transmit, by way of the wireless communication interface to the hearing device, the stereo audio output signal for presentation to the listener by the hearing device.

* * * * *